US008176867B2

(12) United States Patent
Gayton

(10) Patent No.: US 8,176,867 B2
(45) Date of Patent: May 15, 2012

(54) WATERCRAFT IMMOBILIZING SYSTEM

(75) Inventor: Richard J.A. Gayton, Phillipsburg, NJ (US)

(73) Assignee: Richard J. A. Gayton, Phillipsburg, NJ (US)

( * ) Notice: Subject to any disclaimer, the term of this patent is extended or adjusted under 35 U.S.C. 154(b) by 234 days.

(21) Appl. No.: 12/473,659

(22) Filed: May 28, 2009

(65) Prior Publication Data

US 2010/0300346 A1 Dec. 2, 2010

(51) Int. Cl.
*B63G 9/00* (2006.01)

(52) U.S. Cl. ..... 114/240 D; 89/1.34

(58) Field of Classification Search ..... 114/240 C, 114/240 R, 254, 382, 240 D, 240 E, 241, 114/243, 253; 89/1.34
See application file for complete search history.

(56) References Cited

U.S. PATENT DOCUMENTS

| | | | | |
|---|---|---|---|---|
| 885,412 | A | | 4/1908 | Wiliams |
| 1,204,547 | A | | 11/1916 | Corrado et al. |
| 1,223,536 | A | | 4/1917 | Travelstead |
| 1,247,686 | A | | 11/1917 | Jackson, Jr. |
| 1,256,346 | A | | 2/1918 | Mattson |
| 1,271,415 | A | | 7/1918 | Bacon |
| 1,274,299 | A | | 7/1918 | McGowan |
| 1,280,525 | A | | 10/1918 | Nittner |
| 1,298,325 | A | | 3/1919 | Garaca |
| 1,328,549 | A | | 1/1920 | Thompson |
| 1,330,729 | A | | 2/1920 | Starr |
| 1,333,224 | A | | 3/1920 | Sperry |
| 1,772,888 | A | * | 8/1930 | Elia ..... 114/241 |
| 2,313,664 | A | | 3/1943 | Mount |
| 2,383,095 | A | | 8/1945 | Wallace |
| 2,386,950 | A | | 10/1945 | Hopkins |
| 2,395,056 | A | * | 2/1946 | Luby ..... 114/240 R |
| 2,668,512 | A | | 2/1954 | Klas |
| 2,967,505 | A | | 1/1961 | Klas |
| 3,687,418 | A | | 8/1972 | Halvorsen |
| 3,943,644 | A | | 3/1976 | Walz |
| 5,069,109 | A | | 12/1991 | Lavan, Jr. |
| 6,325,015 | B1 | | 12/2001 | Garcia et al. |
| 6,359,833 | B1 | | 3/2002 | English |
| 6,591,774 | B2 | | 7/2003 | Metherell et al. |
| 7,092,315 | B2 | | 8/2006 | Olivier |
| 7,509,769 | B2 | | 3/2009 | Wilcox et al. |
| 2001/0032577 | A1 | | 10/2001 | Swartout et al. |

(Continued)

FOREIGN PATENT DOCUMENTS

DE 10122254 (A1) 11/2002

(Continued)

OTHER PUBLICATIONS

Merchant Maritime Warfare Centre, MMWC Propeller Arresters Stop Unlawful Boarding of Vessels Without Force, The Journal of Commerce—Press Release, March 17, 2010.

(Continued)

*Primary Examiner* — Lars A Olson
(74) *Attorney, Agent, or Firm* — Kramer Levin Naftalis & Frankel LLP

(57) ABSTRACT

A watercraft immobilizing apparatus and system deployable from a marine vessel to passively defend against an attacking watercraft includes a towed array of entanglement lines. The entanglement lines can be stored on and supplied from one or more storage cartridges mountable on and deployed via outriggers and submersible rollers to foul and immobilize propellers and engine cooling intakes of attacking watercraft.

28 Claims, 9 Drawing Sheets

U.S. PATENT DOCUMENTS

| | | | |
|---|---|---|---|
| 2004/0014132 | A1 | 5/2004 | Adler |
| 2004/0194688 | A1 | 10/2004 | Metherell et al. |
| 2007/0017432 | A1 | 1/2007 | Farinella et al. |
| 2009/0038530 | A1 | 2/2009 | Truong et al. |
| 2009/0084284 | A1 | 4/2009 | Martinez et al. |

FOREIGN PATENT DOCUMENTS

| | | | |
|---|---|---|---|
| FR | 2557568 (A1) | | 7/1985 |
| GB | 2 371 024 | A | 7/2002 |
| WO | WO 99/30966 | | 6/1999 |
| WO | WO/03/085207 (A2) | | 10/2003 |
| WO | WO/2004/075132 | | 2/2004 |
| WO | WO/2005/113371 (A2) | | 1/2005 |
| WO | WO 2005/113330 | A1 | 12/2005 |
| WO | WO 2006/083429 | A2 | 8/2006 |
| WO | WO 2007/081292 | A1 | 7/2007 |
| WO | WO 2007/100835 | A2 | 9/2007 |
| WO | WO/2008/100278 | | 8/2008 |
| WO | WO 2009/020602 | A2 | 2/2009 |

OTHER PUBLICATIONS

Counter Piracy Net by APMSS—Advertisement on http://www.apmss.co.uk (Int'l Patent apparently pending—but no further information found.Counter Piracy Net by APMSS.

"Non-Lethal Ballistic Net System Stops Small Boats", www.entrepreneur.com, PRNewswire, Apr. 15, 2009.

"Pneumatic Net Thrower for Ships (anti-piracy) Sea Scorpion Systems LVI", www.seascorpion.co.uk.

www.p-trp.eu, 2010.

* cited by examiner 6C
6E
6D
5B
6G
6B
6H
6I
6F
6J

WATERCRAFT IMMOBILIZING SYSTEM

FIELD OF INVENTION

The present invention generally relates to a passive, non-lethal marine vessel defense apparatus and system that can immobilize attacking watercraft.

BACKGROUND OF INVENTION

Maritime piracy (as well as potential acts of terrorism) targeting both commercial and non-commercial vessels has become very prevalent in recent years. According to available data, there were approximately 160 recorded attacks globally in 2008, where a third of this figure resulted in successful attacks. Pirates have proven that the use of high speed conventionally powered watercraft is highly effective and very difficult to deter. Prior experience in the Gulf of Aden has shown that successful attacks are conducted during twilight hours, from astern of and on the port quarter of the targeted vessel. It is the general policy of insurance companies to pay the very high ransoms demanded for hijacked international flag vessels, cargoes and crews. The current deterrents being utilized generally favor the use of armed guards. However, international authorities do not recommend such danger prone and potentially lethal methods.

Therefore, there is a need for a primary, stand-alone, passive, non-lethal and cost-effective marine vessel defense apparatus and system that can immobilize an attacking watercraft (whether detected or undetected).

SUMMARY OF THE INVENTION

Generally speaking, the present invention is directed to embodiments of a simple to use, relatively inexpensive, non-lethal watercraft immobilizing apparatus and system that can be deployed from a marine vessel as a passive shield around assailable faces of the vessel to defend against attacking watercraft, providing effective immobilization, at a maximum range from the marine vessel, by fouling propellers and water intakes of the attacking watercraft, regardless of whether the attacking watercraft is or is not detected.

Embodiments of the present invention include a towed array of wires, SPECTRA lines or nylon lines ("lines") just below the surface of the water, weighted for neutral buoyancy, and deployed from removable/replaceable cartridges (that can be disposed of after use or refurbished) mounted on various portions of the vessel. The lines can be biodegradable. An arrangement of secondary and possibly tertiary lines can also be deployed from the lines.

Banks of suspended, weighted, submersible dual rollers direct the lines fed from the cartridges, which can be deployed and recovered by means of motors, for example, including by remote control. Each bank features secondary winches at the extremities that can also be operated by electric motor. These winches hold the wire/line that deploys the weighted submersible dual rollers for each bank. The weighted dual rollers are configured to place the towed array below the surface adjacent to the cartridges. The weighted dual rollers may also be prevented from riding above the surface of the water via preventer wires, which can be led from the roller extremities to a strong point on deck forward of the roller installation. A main bank of storage rollers can be mounted off the vessel's transom (e.g., suspended not from outriggers, but from the vessel's existing aft structures, such as, for example, the stern bulwark). Two transom outriggers, one at each extremity, can deploy second and third banks of rollers. The weighted submersible dual rollers in the way of these aft outriggers are configured to be connectable to the extremities of the rollers of the main transom bank, effectively forming one rigid unit.

Deep fins can be situated at the outer extremities of these rollers to prevent the lines of the towed side arrays from fouling the vessel's own propeller. Two additional outriggers can deploy fourth and fifth banks of rollers at the vessel's forward shoulders (port and starboard sides). These banks can be similarly fitted with powered submersible dual rollers to effectively deploy the side arrays and shield the vessel's sides. Each cartridge can supply multiple main lines and an array of secondary lines through the adjacent submersible rollers. The ends of each of the main lines for each cartridge can be held in a submerged pattern by weighted spreader bars, which can be suitably finned for improved stability.

It is therefore an object of the present invention to provide a passive, non-lethal, easy-to-use, and cost-effective defensive shield around a marine vessel to immobilize and thus repel attacking watercraft (whether or not such watercraft have been detected).

Still other objects and advantages of the invention will in part be obvious and will in part be apparent from the specification.

The present invention accordingly comprises the features of construction, combination of elements, and arrangement of parts that will be exemplified in the constructions hereinafter set forth, and the scope of the invention will be indicated in the claims.

BRIEF DESCRIPTION OF THE DRAWINGS

For a fuller understanding of the present invention, reference is had to the following description of exemplary embodiments taken in connection with the accompanying drawings in which.

DESCRIPTION OF THE PREFERRED EMBODIMENTS

Marine engines are designed to propel a watercraft by moving water in various ways, for example, through open or enclosed propellers, through jet engines and through cooling systems. It will be appreciated that the towed array according to embodiments of the present invention moves with this water into the attacking vessel's propellers, cooling intakes or jet intakes, hence fouling and stopping the engine(s). Any entangled lines due to this fouling will part as a result of the weight of the immobilized attacking vessel.

Figure 1:
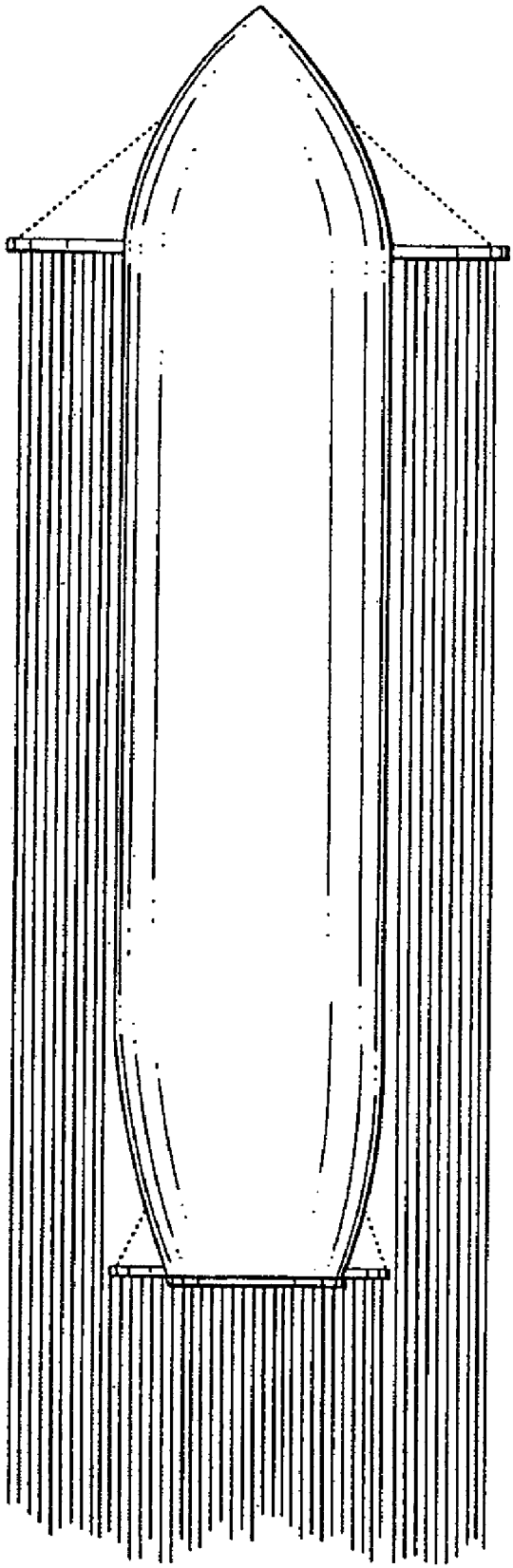
FIG. 1 is a simplified plan view of a marine vessel deploying a watercraft immobilizing apparatus and system in accordance with an embodiment of the present invention, illustrating exemplary positioning of a main transom bank of storage rollers and lines, aft outrigger banks, forward shoulder outrigger banks, and forward outrigger stays.

Referring now to the drawing figures, FIG. 1 illustrates an exemplary coverage pattern of the sub-surface towed line array and positioning of the main storage and outrigger banks relative to the protected vessel. Preferably, there are five storage banks (transom, port quarter, starboard quarter, port shoulder, and starboard shoulder). It should be understood that the only locations on the vessel that need not be protected by towed arrays are the bow areas where the bow wave creates a highly dangerous position for smaller boats to attack.

Figure 9:
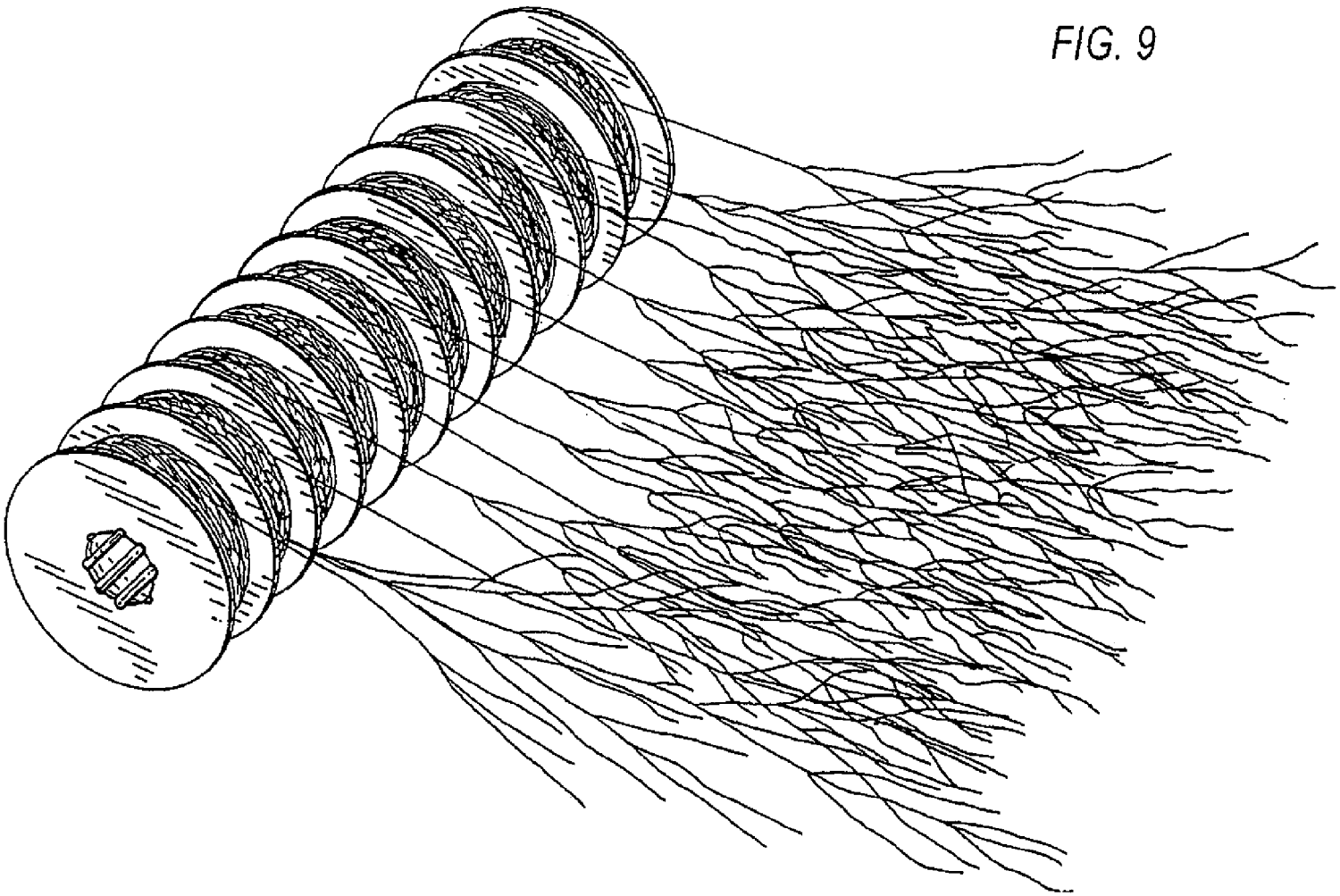
FIG. 9 depicts a loaded cartridge supplying primary lines, with secondary and tertiary lines, of a watercraft immobilizing apparatus and system in accordance with an embodiment of the present invention.

Each storage bank can deploy cartridges including multiple main lines suitably spaced (e.g., approximately, four inches apart). The multiple main lines supplied by each cartridge (see, e.g., FIG. 9) can be weighted for neutral buoyancy and can be fitted with weighted end spreaders (see FIG. 2). The spreaders can be finned for increased underwater stability and/or interlinked to adjacent spreaders.

Figure 2:
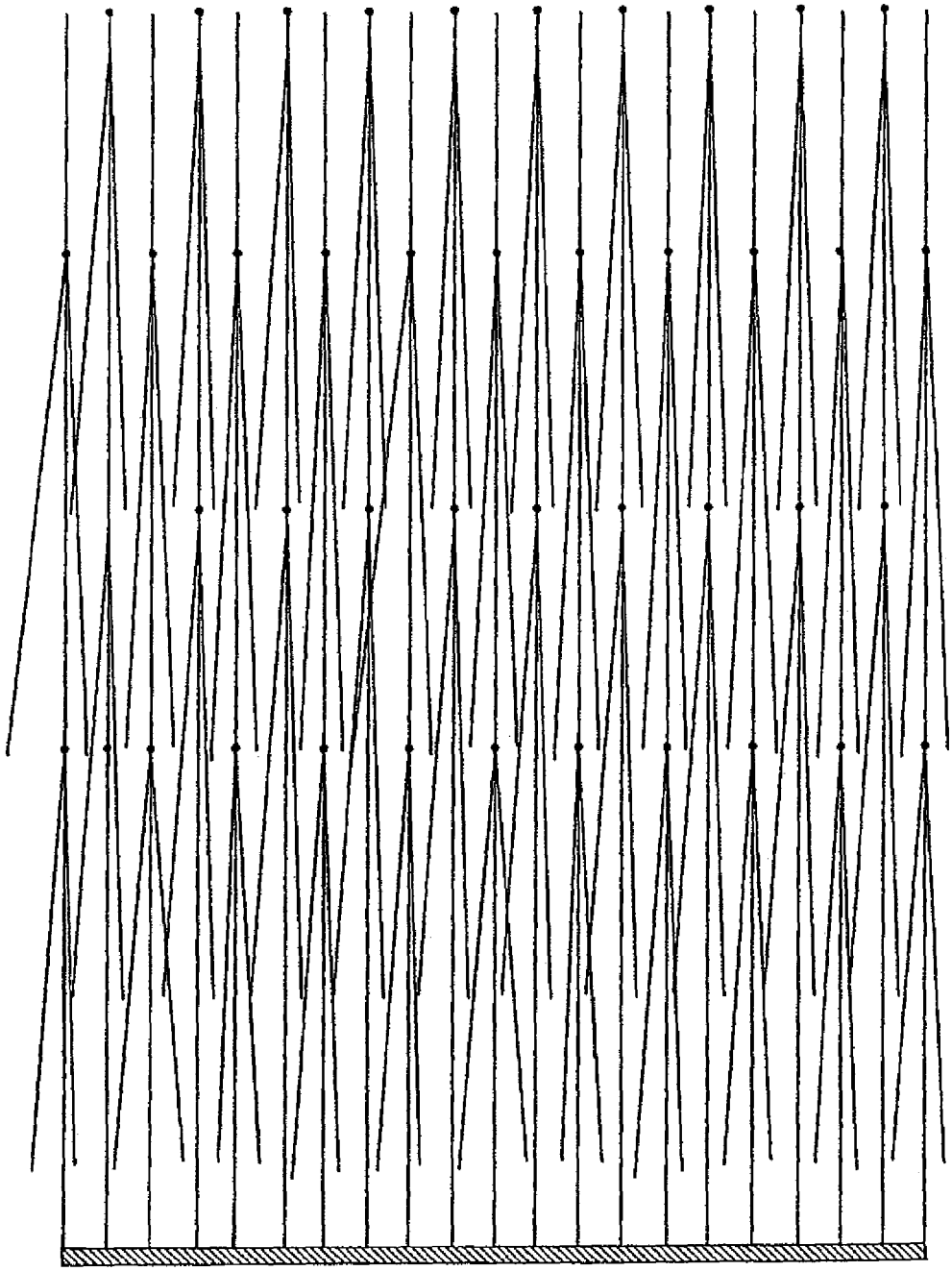
FIG. 2 depicts the extremity (fitted with a spreader) of a cartridge's towed array of lines (staggered secondary line sequence) of a watercraft immobilizing apparatus and system in accordance with an embodiment of the present invention.

The lines can be provided with secondary and/or tertiary sub-lines of similar or smaller diameter, with varying lengths and staggered placement of intervals (preferably, of not more than five feet) along the main lines of the towed array (see e.g., FIG. 2). The main bank (see, e.g., FIG. 3) desirably spans the entire width of the vessel's transom. Damaged portions of the towed array can be renewed/replaced by removing and inserting a new or reconditioned cartridge. Cartridges desirably include the neutrally weighted primary lines as well as the secondary and tertiary lines and any end spreader component.

Figure 4:
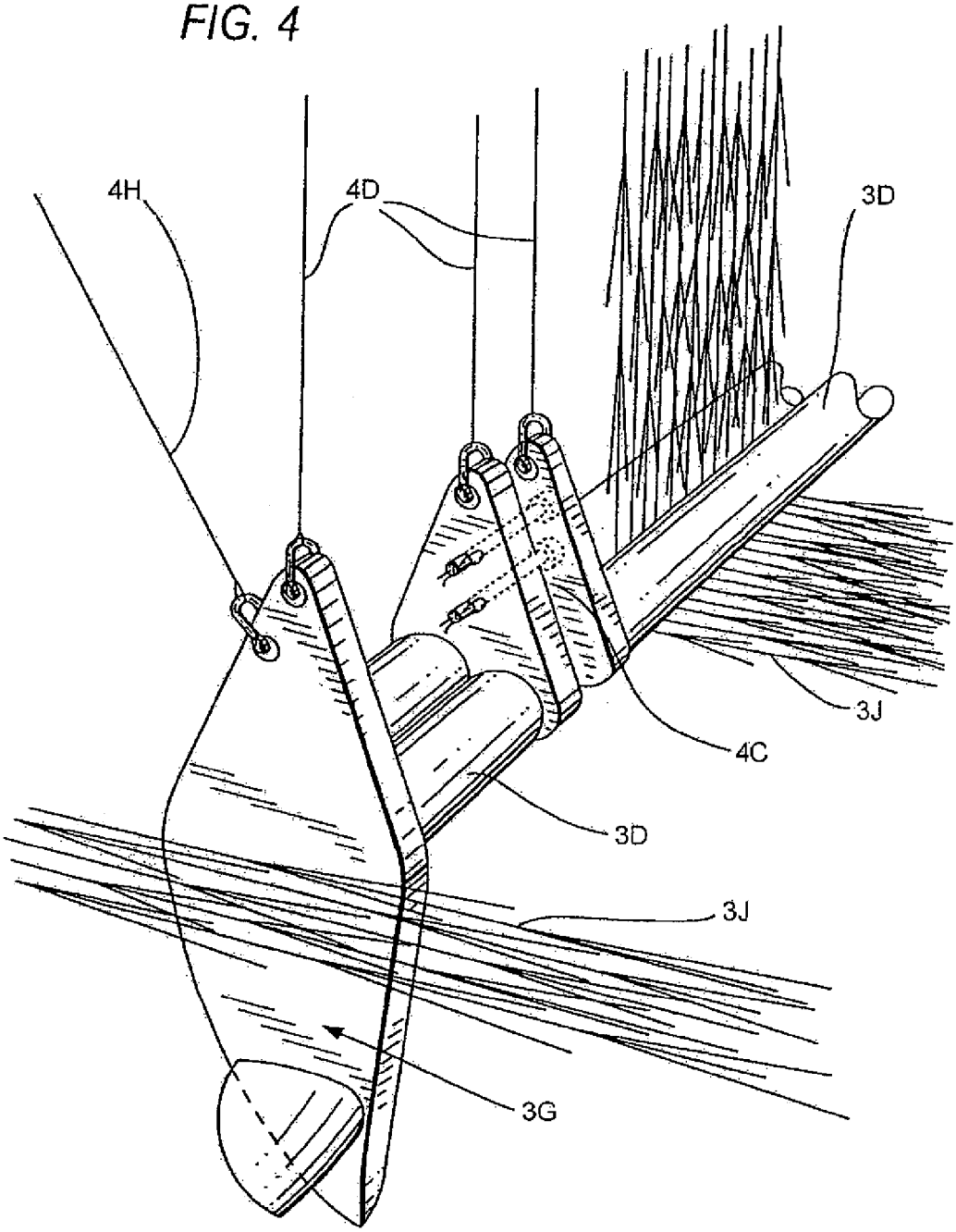
FIG. 4 depicts weighted sub-surface dual rollers of a main transom line bank and a stern outrigger bank (portside), cross connection, main support wires, deep finned side and stern towed arrays, and portside fore stay of a watercraft immobilizing apparatus and system in accordance with an embodiment of the present invention.

Adjacent to the main transom bank are two stern quarter outriggers—port and starboard sides (see, e.g., FIG. 4). The stern outriggers are configured to deploy extensions of the main transom towed array to the full width of the protected vessel's parallel body. The length of the quarter outriggers can be proportional to the difference between the length of the main transom bank and the overall beam of the vessel.

The towed stern array extends aft of the vessel—desirably, not less than 3,000 feet. The forward shoulder outriggers deploy side towed arrays of desirably not less than twenty feet in width/span, off the port and starboard sides. These side towed arrays desirably extend aft at least 3,000 feet and overlap the stern mounted towed array, outboard of the deep fin positioned at the extremities of the stern quarter dual submersible roller.

Figure 3:
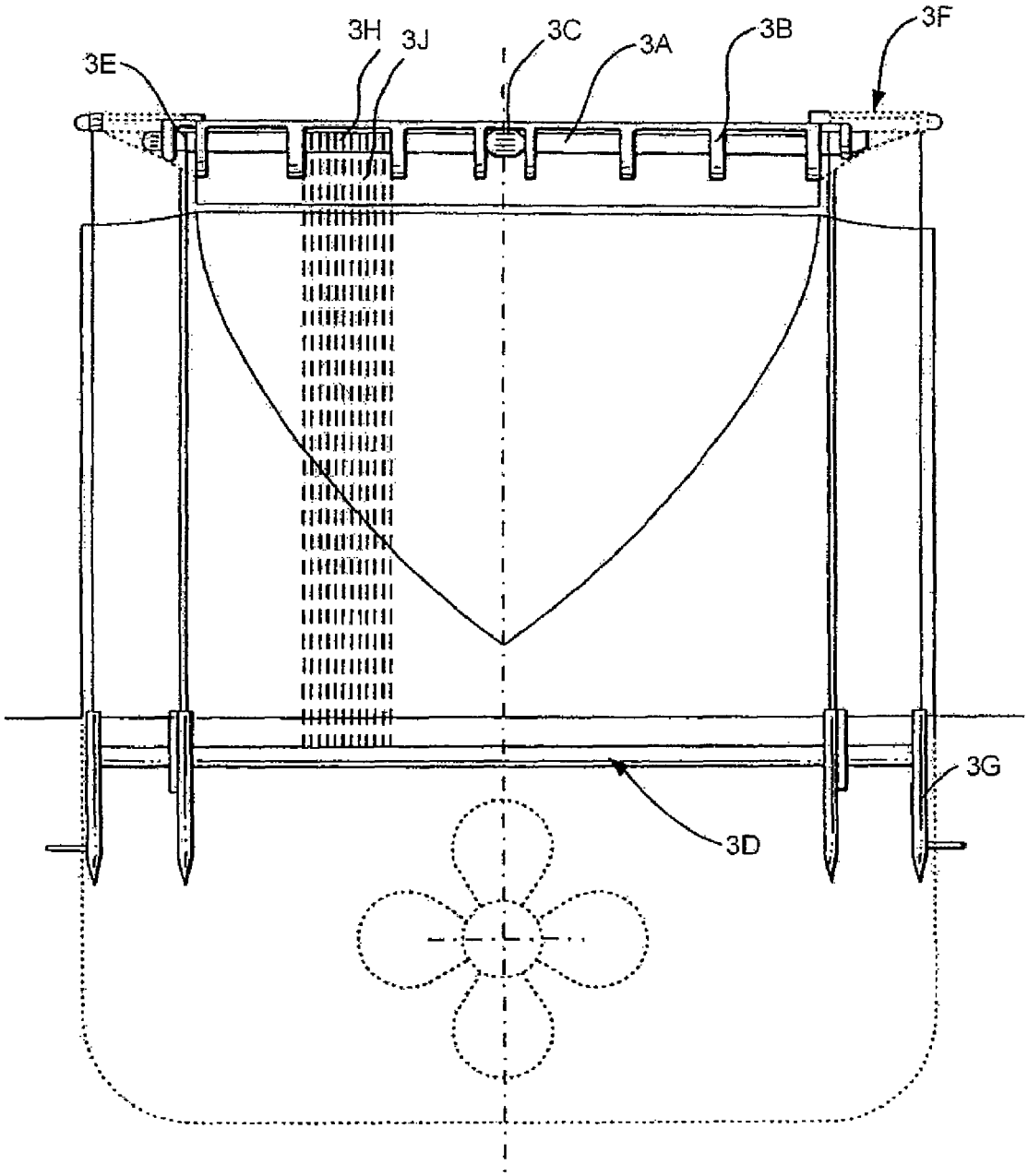
FIG. 3 is a stern (transom) view (including below the water line) of a vessel deploying a watercraft immobilizing apparatus and system in accordance with an embodiment of the present invention, illustrating exemplary positioning of a main transom line bank with six cartridges, cartridge mounts/bearings, main bank electric drive motor, submersible weighted dual rollers, supporting winch/motor, stern outrigger assembly, deep fin, and towed array lines (shown supplied from a single cartridge)
Figure 7:
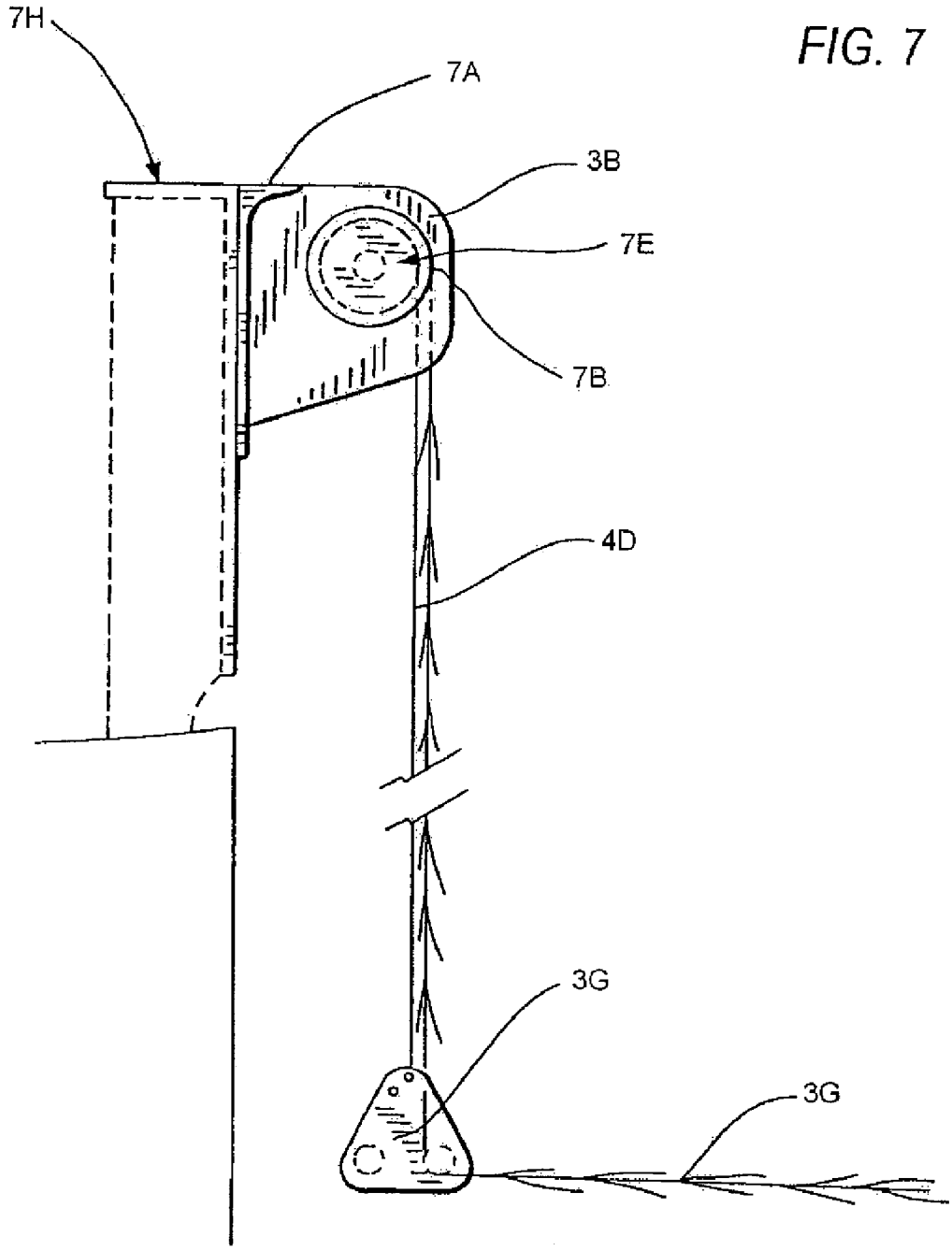
FIG. 7 is a cross-sectional (portside) view through a main transom line bank and submersible weighted rollers of a watercraft immobilizing apparatus and system in accordance with an embodiment of the present invention.
Figure 8:
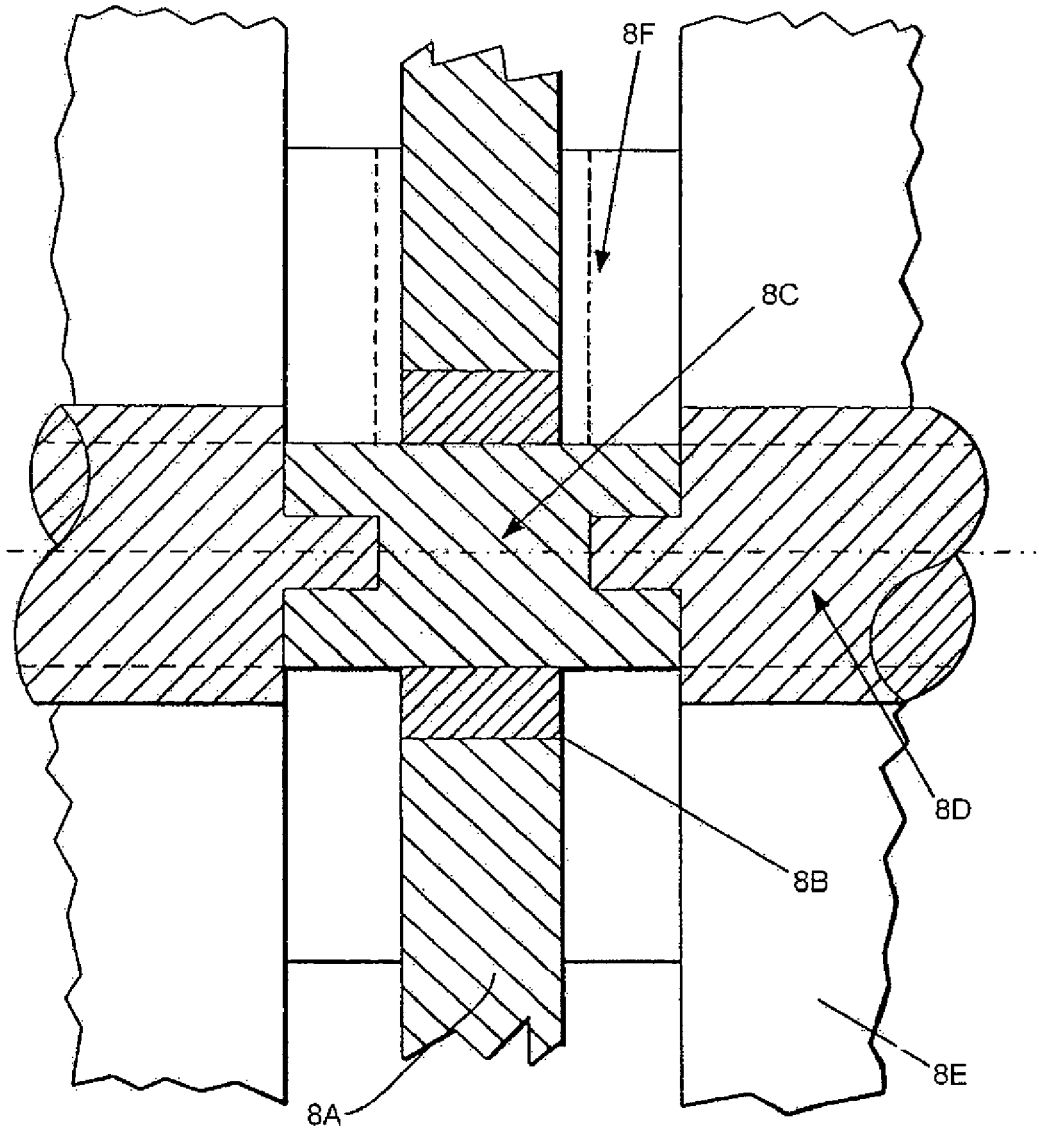
FIG. 8 is across-sectional view through a cartridge of a watercraft immobilizing apparatus and system in accordance with an embodiment of the present invention.

The main transom bank may be fitted by steel brackets to the vessel's existing structures, such as the aft bulwark (see, e.g., FIG. 7). The body of this component supports multiple flanges that incorporate intermediate (preferably, stainless steel) shafts and bearings. The intermediate shaft ends are preferably notched to receive the removable stainless steel cartridge shafts (see FIG. 8). These shafts can then be locked into place—e.g., by rotatable locking rings (see FIG. 8, element 8F) positioned at each end in the way of the flanges. The cartridge shafts can have splines or key ways (see FIG. 8, element 8D) to prevent the cartridges from rotating on the shaft. The complete shaft assembly can then be driven by a centrally mounted electric motor (see FIG. 3, element 3C) that can be remotely controlled. This shaft assembly can also be fitted with a locking device to prevent forced rotation when the sub-surface array is deployed. Secondary winches (see FIG. 3, element 3E) similarly powered by electric motors are preferably provided at the main transom bank. These winches store the support wires for the main transom bank dual submersible weighted rollers (FIG. 3, element 3D, and FIG. 4). The winches can be similarly locked when the dual submersible rollers are deployed. These submersible rollers are configured to place the towed array just below the surface of the water and immediately below the main transom bank.

When deployed, the stern quarter outriggers (see, e.g., FIGS. 3 and 4) are in a generally perpendicular position, but the outriggers can also be rotated parallel to the vessel's main axis and removed when not in use and locked in stowed or deployed positions. The body of the outrigger similarly supports multiple flanges that incorporate intermediate (preferably, stainless steel) shafts and bearings. The intermediate shaft ends are similarly notched to receive the removable cartridge shafts that are similarly locked in place. The complete quarter outrigger shaft assemblies are then driven by inboard mounted electric motors, which can be remotely controlled. These quarter outrigger shaft assemblies can also be fitted with locking devices to prevent forced rotation when the sub-surface array is deployed. Secondary winches similarly powered by electric motors are situated at the extremities of the quarter outrigger storage bank rollers. These winches store the support wires for the quarter outrigger bank dual submersible weighted rollers (see FIGS. 3 and 4). These winches can be similarly locked when the dual submersible rollers are deployed. The submersible rollers are configured to lock into place adjacent to the main transom dual submersible rollers to form a rigid unit (see, e.g., FIG. 4). These units similarly place the towed array just below the surface of the water and immediately below the quarter outrigger banks. The outboard extremities of these submersible dual rollers can be fitted with deep fins (see, e.g., FIG. 3, element 3G) to prevent the towed side arrays from coming into contact with the protected vessel's own propeller(s). The submersible dual roller extremities may also be fitted with fore stays (see FIG. 4) to prevent the assembly from riding aft and away from the vessel's transom.

Figure 5:
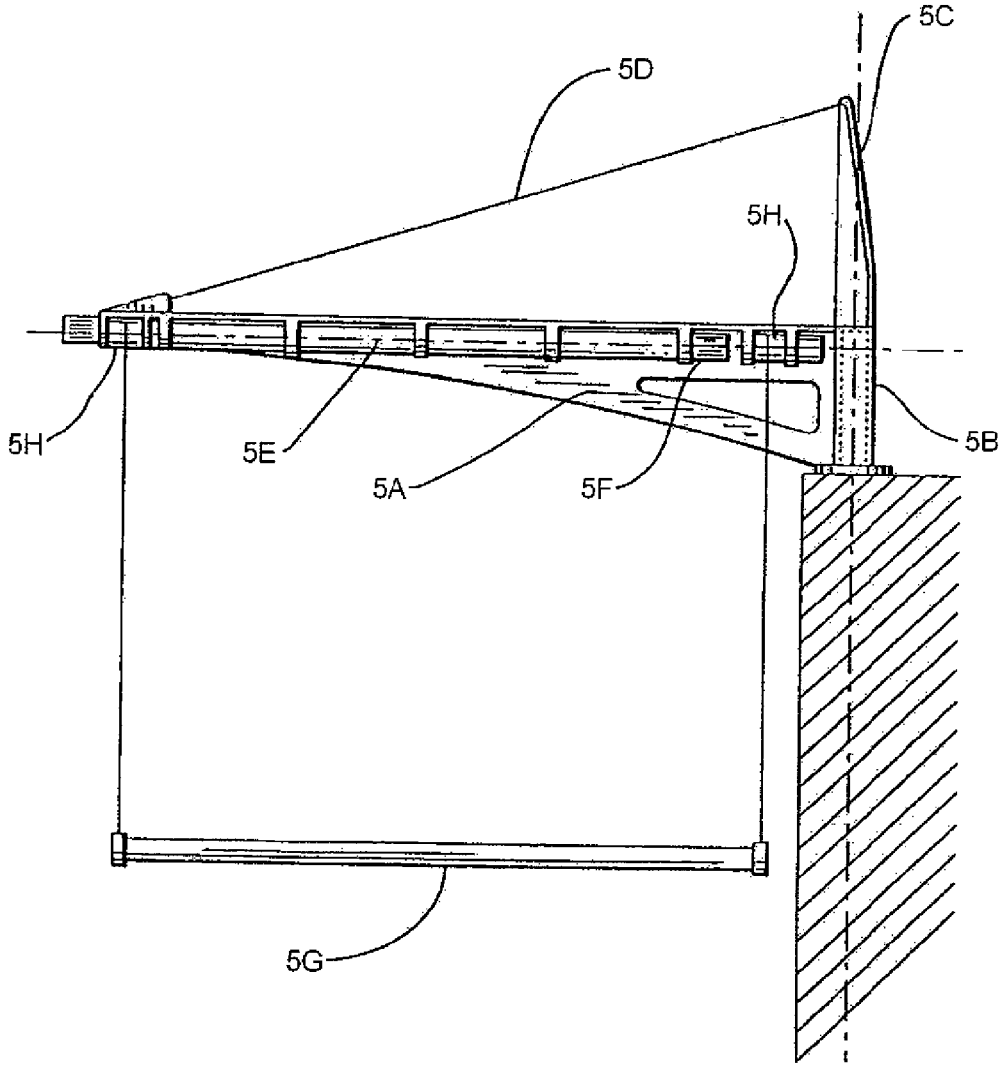
FIG. 5 is an aft view of a portside shoulder outrigger assembly with submersible weighted rollers of a watercraft immobilizing apparatus and system in accordance with an embodiment of the present invention.
Figure 6:
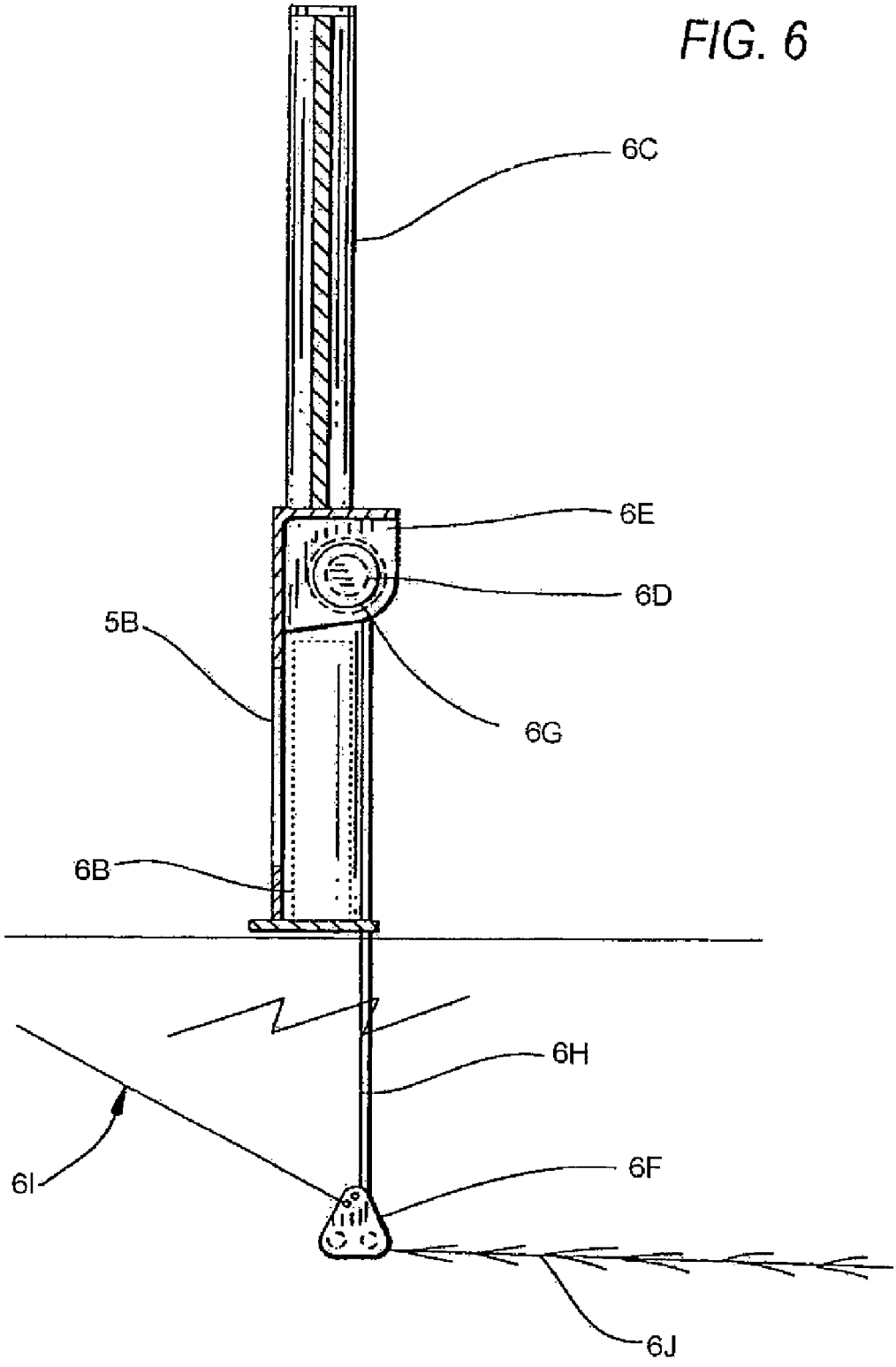
FIG. 6 is a side view of a portside shoulder outrigger assembly with submersible weighted rollers of a watercraft immobilizing apparatus and system in accordance with an embodiment of the present invention.

The larger forward outriggers (see FIGS. 5 and 6), situated at the port and starboard shoulders of the protected vessel, are similar in design to the preferably smaller stern quarter outriggers. These outriggers can also be rotated parallel to the vessel's main axis when not in use and locked in stowed or deployed positions. The body of the outrigger similarly supports multiple flanges that incorporate intermediate (preferably, stainless steel) shafts and bearings (see FIG. 8). The intermediate shaft ends are similarly notched to receive the removable cartridge shafts which are similarly fixed by the rotatable locking ring (see FIG. 8, element 8F). The complete shoulder outrigger shaft assemblies are then driven by inboard mounted electric motors which may be remotely controlled. These shoulder outrigger shaft assemblies can also be fitted with locking devices to prevent forced rotation when the sub-surface array is deployed. Secondary winches similarly powered by electric motors are preferably provided at the extremities of the shoulder outrigger storage bank rollers. These winches can store the support wires for the shoulder outrigger bank dual submersible weighted rollers see FIG. 5, element 5G). These winches can be similarly locked when the dual submersible roller system is deployed. The submersible dual roller extremities can also be fitted with fore stays connected via bridles (see FIG. 6, element 6I) to prevent the assembly from riding aft and away for beneath the shoulder outrigger assembly.

Accordingly, the present invention provides embodiments of a marine vessel defense apparatus and system, the novel characteristics of which provide a non-lethal, passive, cost-effective means to prohibit attacking watercraft from closely approaching a protected vessel whilst it is underway.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A watercraft immobilizing apparatus deployable from a marine vessel, said apparatus comprising lines towable by said vessel in surrounding water, said lines configured to extend at least one of along-side and from at least one assailable portion of said vessel and generally parallel to the surface of said surrounding water when towed by said vessel for at least one of (i) entangling a propeller and (ii) fouling an engine intake of a surface watercraft situated proximate to said vessel to immobilize said watercraft, and at least one cartridge configured to store and supply said lines.

2. The apparatus of claim 1, wherein said at least one cartridge is mountable to at least one outrigger of said vessel.

3. The apparatus of claim 2, further comprising at least one outrigger submersible dual roller unit suspended below said at least one outrigger, said at least one outrigger submersible dual roller unit being configured to guide said lines.

4. The apparatus of claim 3, wherein an end of said at least one outrigger submersible dual roller unit includes one or more fins operable to prevent said lines from fouling at least one of the marine vessel's own propeller and the marine vessel's own engine intake.

5. The apparatus of claim 1, wherein said at least one cartridge is at least one of removable, discardable, replaceable, and reconditionable.

6. The apparatus of claim 1, further comprising at least one aft submersible dual roller unit suspended from a stern bulwark of said vessel, said at least one aft submersible dual roller unit being configured to guide said lines, supplied by said at least one cartridge, aft of said vessel.

7. The apparatus of claim 6, wherein said at least one aft submersible dual roller unit and at least one outrigger submersible dual roller unit form a single unit.

8. The apparatus of claim 1, wherein said lines are formed from at least one of wire, NYLON, and a biodegradable material.

9. The apparatus of claim 1, wherein said lines are spreadable, by a forward movement of said vessel, up to three thousand feet astern of said vessel and at least to a distance of twenty feet from a side of said vessel.

10. The apparatus of claim 1, wherein said lines are spaced apart by not more than 4 inches.

11. The apparatus of claim 1, wherein secondary lines extend from at least one line of said lines.

12. The apparatus of claim 11, wherein said secondary lines are staggered along said lines in intervals of not more than five feet.

13. The apparatus of claim 1, wherein said lines are set for neutral buoyancy.

14. A vessel comprising the watercraft immobilizing apparatus of claim 1.

15. A method for immobilizing a watercraft comprising the step of deploying a watercraft immobilizing apparatus as claimed in claim 1.

16. A watercraft immobilizing apparatus deployable from a marine vessel, said apparatus comprising lines towable by said vessel in surrounding water, said lines configured to extend at least one of along-side and from at least one assailable portion of said vessel and generally parallel to the surface of said surrounding water when towed by said vessel for at least one of (i) entangling a propeller and (ii) fouling an engine intake of a surface watercraft situated proximate to said vessel to immobilize said watercraft, wherein said lines are held in a pattern by at least one of (i) at least one adjacent spreader and (ii) an end spreader finned for underwater stability.

17. A watercraft immobilizing system, comprising:

at least one outrigger situated on a portion of a marine vessel;

at least one cartridge mounted to said at least one outrigger, said at least one cartridge configured to store lines and deploy said lines in water surrounding said vessel; and at least one outrigger submersible dual roller unit mounted to said at least one outrigger and configured to suspend below said at least one outrigger for guiding said lines to extend in said surrounding water generally parallel to the surface of said surrounding water when towed by said vessel for at least one of (i) entangling a propeller and (ii) fouling an engine intake of a surface watercraft situated proximate to said vessel to immobilize said watercraft.

18. The system of claim 17, further comprising at least one cartridge mounted on a stern of said vessel.

19. The system of claim 18, further comprising at least one aft submersible dual roller unit suspended from a stern bulwark of said vessel, said at least one aft submersible dual roller unit being configured to guide said lines, supplied by said at least one stern mounted cartridge, aft of said vessel.

20. The system of claim 19, wherein said at least one aft submersible dual roller unit and said at least one outrigger submersible dual roller unit form a single unit.

21. The system of claim 17, wherein said at least one outrigger comprises multiple outriggers, ones of said outriggers situated on a forward port, forward starboard, aft port, and aft starboard portion of said vessel, and wherein each of said outriggers include one of said at least one cartridge and one of said at least one outrigger submersible dual roller unit.

22. A vessel comprising the watercraft immobilizing system of claim 17.

23. A method for immobilizing a watercraft comprising the step of utilizing a watercraft immobilizing system as claimed in claim 17.

24. A cartridge mountable to a portion of a marine vessel, said cartridge comprising at least one roller unit configured to store lines and to deploy said lines such that said lines extend in water surrounding said vessel at least one of along-side and from at least one assailable portion of said vessel and generally parallel to the surface of said surrounding water when towed by said vessel for at least one of (i) entangling a propeller and (ii) fouling an engine intake of a surface watercraft situated proximate to said vessel to immobilize said watercraft.

25. The cartridge of claim 24, wherein said cartridge is mountable to at least one outrigger of said vessel.

26. The cartridge of claim 24, wherein said cartridge is mountable to a stern of said vessel.

27. The cartridge of claim 24, wherein said cartridge is at least one of removable, discardable, replaceable, and reconditionable.

28. A vessel comprising the cartridge of claim 24.

* * * * *